US005875673A

United States Patent [19]

Brzezniak et al.

[11] Patent Number: 5,875,673

[45] Date of Patent: Mar. 2, 1999

[54] ORIENTATION STATION FOR MULTI-STATION METAL-FORMING MACHINES

[75] Inventors: Edward J. Brzezniak, Orland Park; Mark VanHoutum, Chicago, both of Ill.

[73] Assignee: Verson, a Division of Allied Products Corporation, Chicago, Ill.

[21] Appl. No.: 1,226

[22] Filed: Dec. 30, 1997

[51] Int. Cl.[6] ..... B21D 43/20

[52] U.S. Cl. ..... 72/405.08; 72/419

[58] Field of Search ..... 72/405.08, 405.09, 72/405.01, 419; 269/71, 73, 296; 100/207; 198/621.1; 414/749

[56] References Cited

U.S. PATENT DOCUMENTS

| | | | |
|---|---|---|---|
| 3,855,840 | 12/1974 | Kawano | 72/419 |
| 3,875,808 | 4/1975 | Okamoto et al. . | |
| 4,562,719 | 1/1986 | Budrean et al. . | |
| 4,625,850 | 12/1986 | Marsh . | |
| 4,641,515 | 2/1987 | Braun et al. | 72/419 |
| 4,680,954 | 7/1987 | Mueller et al. | 72/422 |
| 4,713,961 | 12/1987 | Hoenhn et al. | 72/419 |
| 4,730,825 | 3/1988 | Mikusch et al. . | |
| 4,761,986 | 8/1988 | Maunz et al. | 72/422 |
| 4,981,031 | 1/1991 | Schneider et al. . | |
| 5,001,921 | 3/1991 | Schneider et al. . | |
| 5,012,665 | 5/1991 | Brandstetter . | |
| 5,048,318 | 9/1991 | Thudium et al. | 72/419 |
| 5,054,306 | 10/1991 | Brzezniak . | |
| 5,097,695 | 3/1992 | Brzezniak . | |
| 5,121,623 | 6/1992 | Brzezniak . | |
| 5,363,684 | 11/1994 | Thudium et al. . | |
| 5,383,348 | 1/1995 | Michael et al. . | |
| 5,385,040 | 1/1995 | Michael et al. . | |
| 5,388,952 | 2/1995 | Hofele et al. | 414/752 |
| 5,429,473 | 7/1995 | Müller et al. | 414/751 |
| 5,632,181 | 5/1997 | Vanderzee et al. | 72/405.11 |

FOREIGN PATENT DOCUMENTS

| | | | |
|---|---|---|---|
| 0325841 | 8/1989 | European Pat. Off. . | |
| 4218818 | 12/1993 | Germany | 72/405.01 |
| 238252 | 11/1985 | Japan . | |
| 24927 | 2/1987 | Japan . | |

OTHER PUBLICATIONS

Ford Motro Company, Chapter 6, Universal Station, 1994. pp. 1,3,5,7,9,11,14,16,18,20,22,24,26,28,30,32,34,49,50,52, 54,57,59,61,63,65,68.

*Primary Examiner*—Daniel C. Crane
*Attorney, Agent, or Firm*—Baker & Botts, L.L.P.

[57] ABSTRACT

A reorientation station has front and rear vertical drives that are spaced apart from each other along a flow axis of the orientation station that coincides with the flow axis of the machine. A pivot carriage support bar is coupled at its front end to the front vertical drive and at its rear end to the rear vertical drive. The vertical drives are operable to move the pivot carriage support bar to predetermined heights and to orient the pivot carriage support bar at predetermined tilt angles. A pivot carriage is mounted on the pivot carriage support bar for rotation about a roll-axis defined by the pivot carriage support bar. A roll drive coupled between the pivot carriage support bar and the pivot carriage rotates the pivot carriage about the roll axis to a selected roll angle. The pivot carriage supports front and rear template carrier bars, which are positioned transversely with respect to the roll axis and are mounted on the pivot carriage in spaced-apart relation axially with respect to the roll axis for movement along paths parallel to the roll axis. Linear drive devices move the template carrier bars along the paths on the pivot carriage to predetermined positions. Automated and remotely controllable devices are provided for releasing the template carrier bars from the carrier brackets that support them on the pivot carriage to pedestals for tool changes.

31 Claims, 6 Drawing Sheets

ORIENTATION STATION FOR MULTI-STATION METAL-FORMING MACHINES

BACKGROUND OF THE INVENTION

The present invention relates to multi-station metal-forming machines, such as transfer presses, and, in particular, to an orientation station of the type that is located between adjacent work stations of the machine, receives the work pieces seriatim from the upstream station, holds them temporarily, and while they are held reorients them for transfer to the downstream station.

Reorientation stations, which are sometimes referred to as universal or depositing stations and are well-known, have template carriers that are mounted on a system of positioning devices for moving the template carriers axially with respect to the flow direction of the work pieces (the x-axis), transversely of the flow direction (the z-axis), and vertically (the y-axis) and for tilting the template carriers forwardly and rearwardly about a transverse axis (the tilt axis) and rolling them from side to side about an axial axis (the roll axis). The template carriers receive templates that match the shapes of portions of the work pieces that arrive from the previous work station and hold the work pieces in a stationary position during reorientation. After reorientation to a position for movement from the reorientation station to the next working station of the machine, the work pieces are picked up and transferred to the next station. Modern reorientation stations are fully automated and computer controlled and operate at very high speeds.

U.S. Pat. No. 5,048,318 (Thudium et al., Sep. 17, 1991, "the '318 patent") describes and shows a depositing station having, starting at the bottom of a stack of positioning mechanisms that operate in series, a z-axis transfer mechanism, an x-axis transfer mechanism, a y-axis lift/lower mechanism, a roll mechanism and a tilt mechanism. Because the x-axis and z-axis mechanisms are at the base of the machine, the station of the '318 patent cannot be used in presses that have equipment, such as liftclamp modules, located between adjacent work stations. The depositing station of the '318 patent also requires devices separate from the depositing station for changing the templates and template carrier bars when the press tooling is changed to produce a different part.

SUMMARY OF THE INVENTION

One object of the present invention is to provide a reorientation station for a multi-station metal-working machine, such as a transfer press, that permits additional equipment, such as liftclamp modules, to be physically accommodated in the spaces between the machine work stations. Another object is to provide a reorientation station that can be used with transfer presses of various designs and that can be retrofit to existing transfer presses. Yet another object is to facilitate changing of the templates of a reorientation station during tool changes.

The foregoing objects are attained, in accordance with the present invention, by a reorientation station that has a front vertical drive adapted to be attached to a support proximate to an upstream work station of the machine and a rear vertical drive adapted to be attached to a support proximate to a downstream workstation of the machine. The vertical drives are spaced apart from each other along a flow axis of the orientation station that is adapted to coincide with a flow axis of the machine along which articles being formed move from the upstream work station to the downstream work station served by the reorientation station. A pivot carriage support bar is coupled at its front end to the front vertical drive and at its rear end to the rear vertical drive. The vertical drives are operable to move the pivot carriage support bar to predetermined heights and to orient the pivot carriage support bar at a predetermined tilt angle about a horizontal tilt axis of the orientation station perpendicular to the flow axis. A pivot carriage is mounted on the pivot carriage support bar for rotation about a roll axis defined by the pivot carriage support bar. A roll drive coupled between the pivot carriage support bar and the pivot carriage rotates the pivot carriage about the roll axis to a selected roll position. The pivot carriage receives front and rear template carrier bars, which are positioned transversely with respect to the roll axis and are mounted on the pivot carriage in spaced-apart relation axially with respect to the roll-axis for movement along paths parallel to the roll axis. Linear drive devices move the template carrier bars along the paths on the pivot carriage to predetermined positions.

The front vertical drive may have a movable drive rod that is coupled to the front end of the pivot carriage support bar by a front coupling. Similarly, the rear vertical drive has a movable drive rod that is coupled to the rear end of the pivot carriage support bar by a rear coupling. The couplings are arranged to prevent one end of the pivot carriage support bar from moving axially relative to the drive rod to which that end is coupled, to prevent the pivot carriage support bar from rotating about the roll axis, and to permit the carriage support bar to tilt. The other coupling permits the end of the support bar that it receives to slide axially and tilt about a horizontal axis.

In an advantageous arrangement from the points of view of conserving space and minimizing the number of components, the roll drive may include a roll servo-motor mounted on the underside of the pivot carriage and a roll drive linkage coupled between the roll servo-motor and the pivot carriage support bar. A suitable roll drive linkage includes an arcuate gear sector affixed to the pivot carriage support bar and concentric with the roll axis and a drive pinion coupled to the roll servo-motor and meshing with the gear sector.

The foregoing arrangement of the y-axis (raise and lower) drive and the tilt drive, namely, front and rear lift drives that are spaced apart in the flow direction of the machine and located lowermost in the series of motion-imparting devices, permit the reorientation station to straddle other equipment of the transfer press that is located between the work stations. The carriage support bar can be made of any suitable length to bridge other equipment between the work stations. The vertical drives require little space, both along the flow axis and transversely of the flow axis. The use of two vertical drives in spaced-apart relation also imparts stability to the pivot carriage in the axial direction. For any given load and speed requirements, the use of two vertical drives permits each drive to be of lower power than would be required if only a single vertical drive were provided.

In preferred embodiments of the reorientation station of the present invention, each of the template carrier bars is supported independently of the other on the pivot carriage; i.e., the front template carrier bar is mounted on a front carrier bar support bracket, the front carrier bar support bracket is received for movement along a front carriage track, the rear template carrier bar is mounted on a rear carrier bar support bracket, and the rear carrier bar support bracket is received for movement along a rear carriage track. The front carriage track and rear carriage track are, advantageously, mounted on the pivot carriage proximate to each other and symmetrically with respect to a vertical plane that includes the roll axis. A front template carriage drive is coupled between the pivot carriage and the front template carrier bar, and a rear template carriage drive is coupled between the pivot carriage and the rear template carrier bar. Each of the front and rear template carriage drives is, preferably, a ball screw and ball nut drive driven by a servo-motor and drive belt. The servo-motor and drive belt of the front template carriage are mounted on a rear end of the pivot carriage, and the servo-motor and drive belt of the rear template carriage are mounted on a front end of the pivot carriage.

Although separate supporting and driving of the template carrier bars makes it possible to facilitate changing the templates when the tooling of the machine is changed to make different parts, as described below, separate supporting and driving of the templates permits lower power motors to be used and conserves space in the flow direction, which are advantageous features apart from the template changing feature of the reorientation machine of the invention.

According to another aspect of the invention, a front template pedestal spaced apart from the front end of the pivot carriage receives and supports the front template carrier bar during a tool change; similarly, a rear template pedestal spaced apart from the rear end of the pivot carriage receives and supports the rear template carrier bar during a tool change. The front carrier bar is movable along the front track to a position in vertical register with the front template pedestal, and the rear carrier bar is movable along the rear track to a position in vertical register with the rear template pedestal. Each template carrier bar is attached to the carrier bar support bracket by a clamping mechanism that is selectively releasable, and is, preferably, automated and remotely controllable, to detach the template carrier bar from the support bracket.

In preferred designs of the template carrier bars, each clamping mechanism is received by the template carrier bar and includes latch levers pivotally mounted on the carrier bar and engageable with the support bracket. Suitable devices carried by the support bar, such as a bar cam driven by pneumatic cylinders that act on cam followers on the clamp levers, selectively move the levers into and out of engagement with the support bracket. The template carriage bar may be tubular and the bar cam and air cylinders received within the template carriage bar.

The above-described arrangement of separate mountings and drives for the template carrier bars and automated, remotely controllable latching of the template carrier bars to the carrier bar supports facilitates tool changes by enabling the reorientation station to place the template carrier bars on the template bar pedestals and leaving there temporarily while the templates are changed. After changing the templates, the template carrier bars are automatically re-engaged with the carrier bar mounting brackets on the tracks of the pivot carriage and restored to normal operation. In the normal operation of the reorientation station, the front and rear template carrier bars are moved in tandem, if necessary as part of the reorienting of the templates to prepare them for transfer to the downstram work station of the machine.

For a better understanding of the present invention, reference may be made to the following description of an exemplary embodiment, taken in conjunction with the accompanying drawings.

DESCRIPTION OF THE EMBODIMENT

Figure 1:
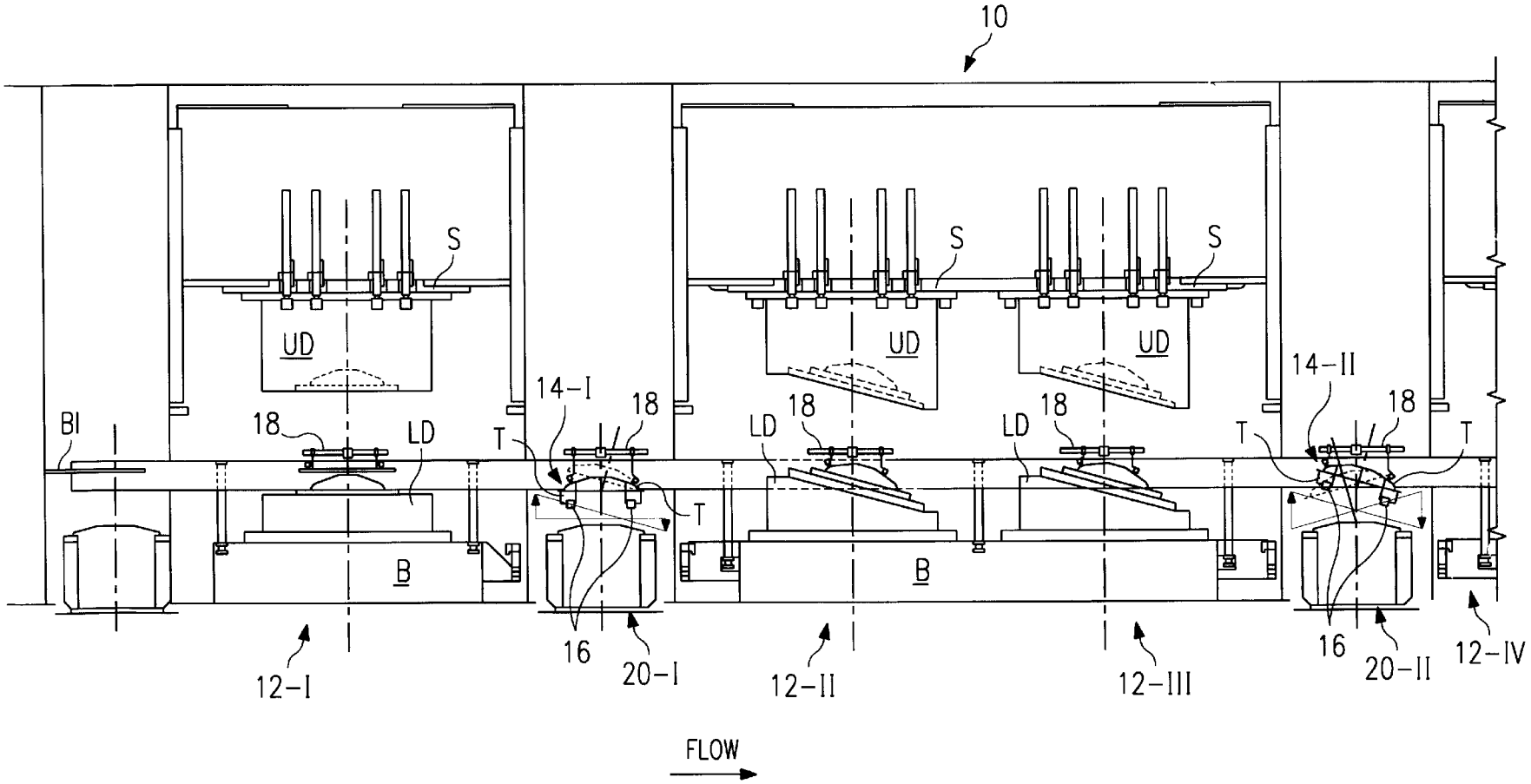
FIG. 1 is a schematic right side elevational view of a transfer press suitable for the reorientation stations of the present invention.

A typical transfer press 10, as shown in FIG. 1, has several die stations 12, e.g., 12-I, 12-II, 12-III and 12-IV, each of which has a bolster B that receives a lower die LD and a slide S that receives an upper die UD. A blank Bl for a work piece that is delivered to the front station 12-I is progressively formed in each die station. Orientation stations 14 between some or all of the adjacent die stations 12 are equipped with templates T that match portions of the work piece as it arrives from the upstream die station and hold the workpiece in a fixed position. The templates are mounted on template carrier bars 16, which are in turn supported by mechanisms and drives that enable the template carrier bars to be moved to change the orientation of the work piece from the orientation in which it is placed on the templates to an orientation that permits it to be positioned properly on the lower die of the next die station. The press shown in FIG. 1 has an orientation station 14-I between die stations 12-I and 12-II and an orientation station 14-II between die stations 12-III and 12-IV. The orientation stations 14 are depicted in FIG. 1 by the template carrier bars 16 and the templates T.

Each die station 12 and each orientation station 14 is served by a suction-cup pickup 18, each of which moves forward (to the left in FIG. 1) from the station it serves to the immediately adjacent upstream station, picks up a workpiece from the upstream station, moves forward to the station it serves and deposits the workpiece on the station it serves. Each pickup dwells between adjacent stations while the stations do their work. The pickups 16 are shown at the stations they serve in FIG. 1.

FIG. 1 shows diagrammatically the orientation of a workpiece as it is deposited on each orientation station 14 by solid lines and the orientation to which it has been moved by the orientation station to ready it for pick-up and transfer to the adjacent downstream die station by dashed lines.

The press 10 shown in FIG. 1 includes a clamp module 20-I between the die stations 12-I and 12-II and a clamp module 20-II between the die stations 12-III and 12-IV. Those clamp modules prevent previously known orientation stations from being used because they occupy space that is needed for the x-axis and z-axis transfer mechanisms. The orientation station of the present invention is constructed to permit the clamp modules, as well as other equipment located between working stations of metal-forming machines, to remain in existing equipment or to be provided in new equipment.

Figure 2:
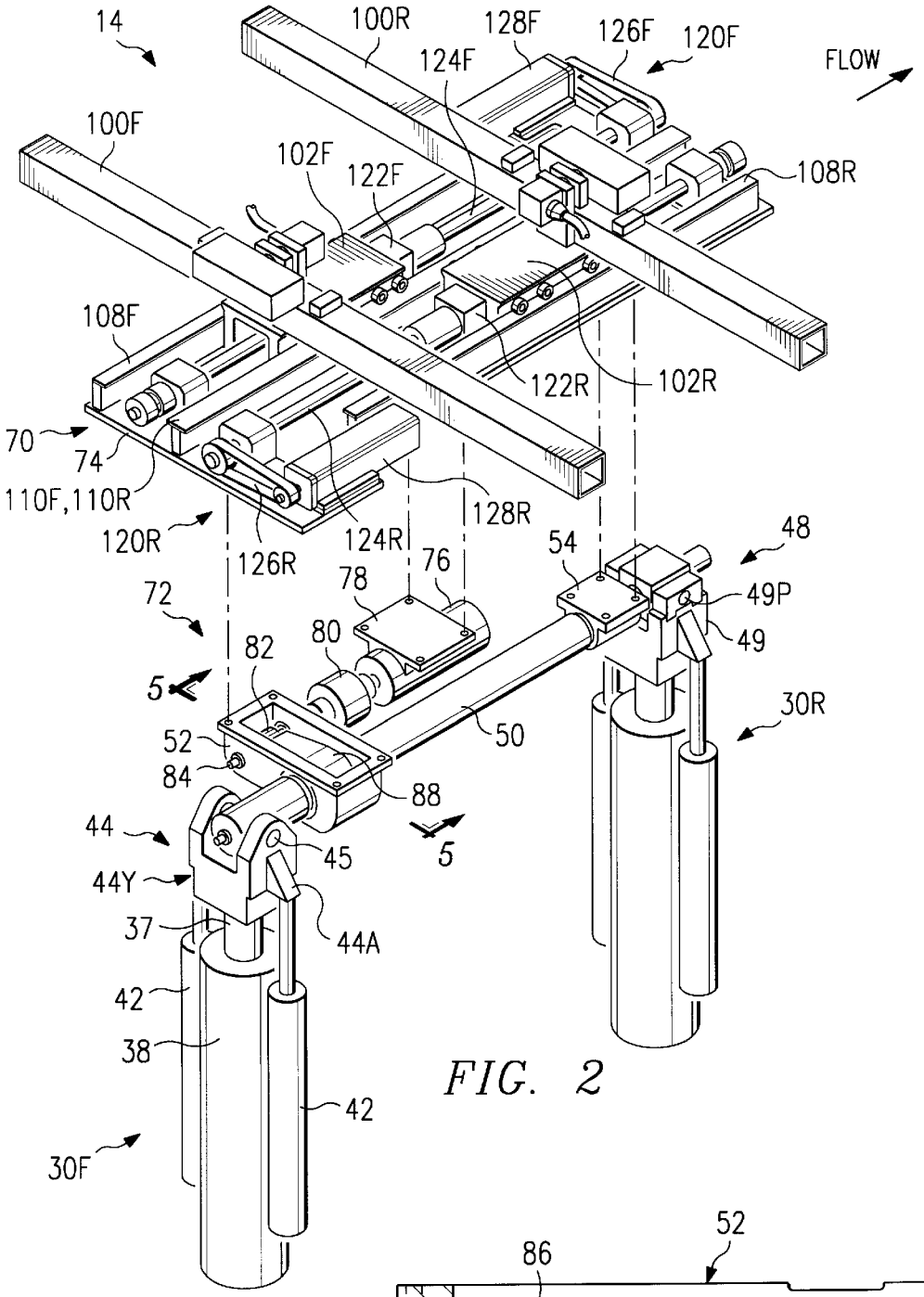
FIG. 2 is an exploded perspective view of the embodiment.

Referring to FIG. 2, the embodiment of an orientation station 14 according to the present invention has a front vertical drive 30F that is adapted to be attached to a support proximate to an upstream work station (e.g., die station 12-I) of the machine and a rear vertical drive 30R that is adapted to be attached to a support proximate to a downstream workstation (e.g., die station 12-II) of the machine. The vertical drives are spaced apart from each other along a flow axis of the orientation station that coincides with a flow axis of the machine, the axis along which articles being formed move from the upstream work station to the downstream work station served by the reorientation station. A pivot carriage support bar 50 is coupled at its front end to the front vertical drive 30F and at its rear end to the rear vertical drive 30R. The vertical drives are operable to move the pivot carriage support bar 50 to predetermined heights and to orient the pivot carriage support bar at a predetermined tilt angle about a horizontal tilt axis of the orientation station perpendicular to the flow axis.

A pivot carriage 70 is mounted on the pivot carriage support bar 50 for rotation about a roll-axis defined by the pivot carriage support bar 50. A roll drive 72 coupled between the pivot carriage support bar 50 and the pivot carriage 70 rotates the pivot carriage 70 about the roll axis to a selected roll position. The pivot carriage 70 receives front and rear template carrier bars 100F and 100R, which are positioned transversely with respect to the roll axis and are mounted on the pivot carriage 70 in spaced apart relation axially with respect to the roll-axis for movement along paths parallel to the roll-axis. Linear drive devices 120F and 120R move the template carrier bars along the paths on the pivot carriage 70 to predetermined positions.

Figure 3:
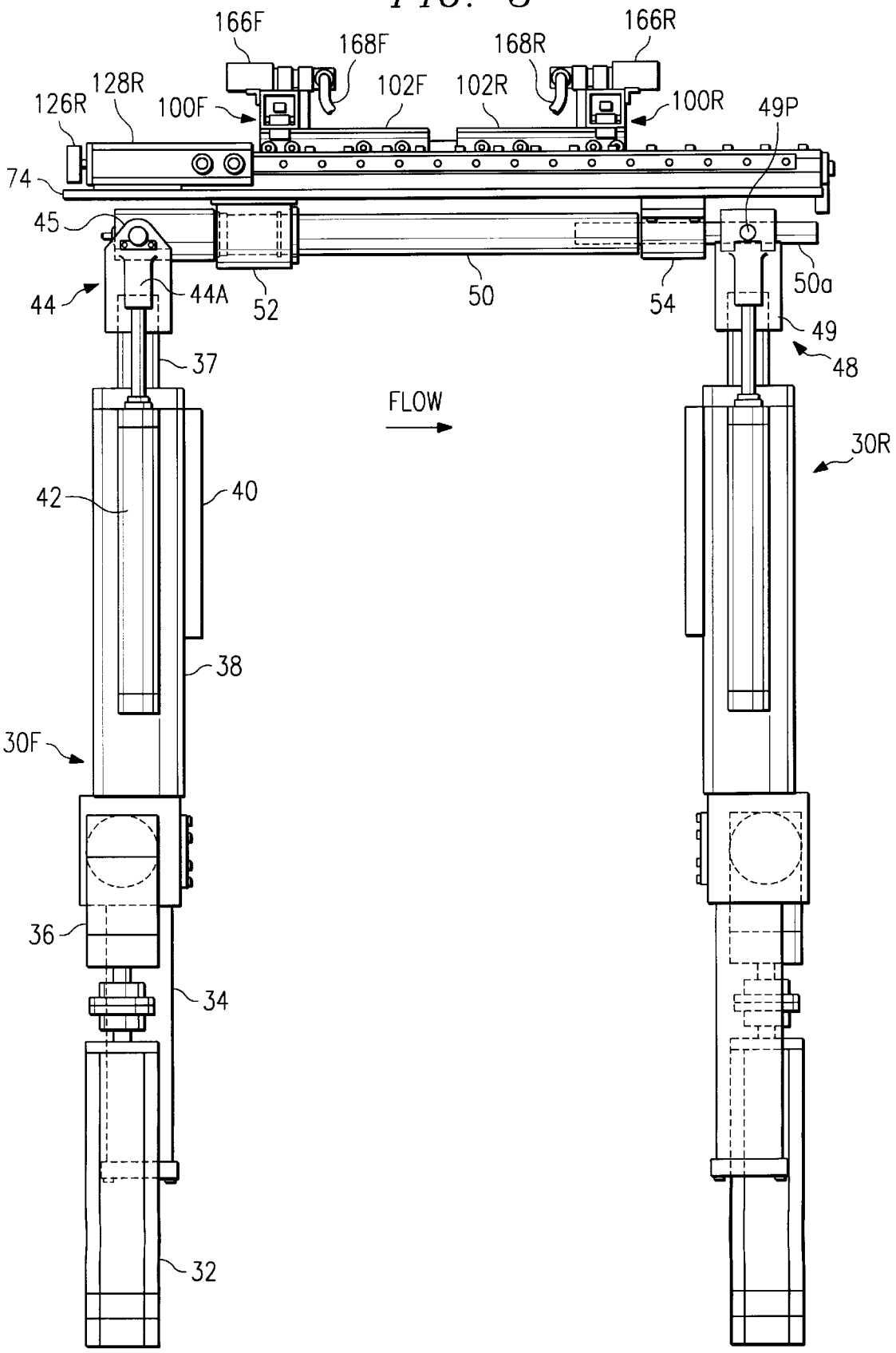
FIG. 3 is a side elevational view of the embodiment.
Figure 4:
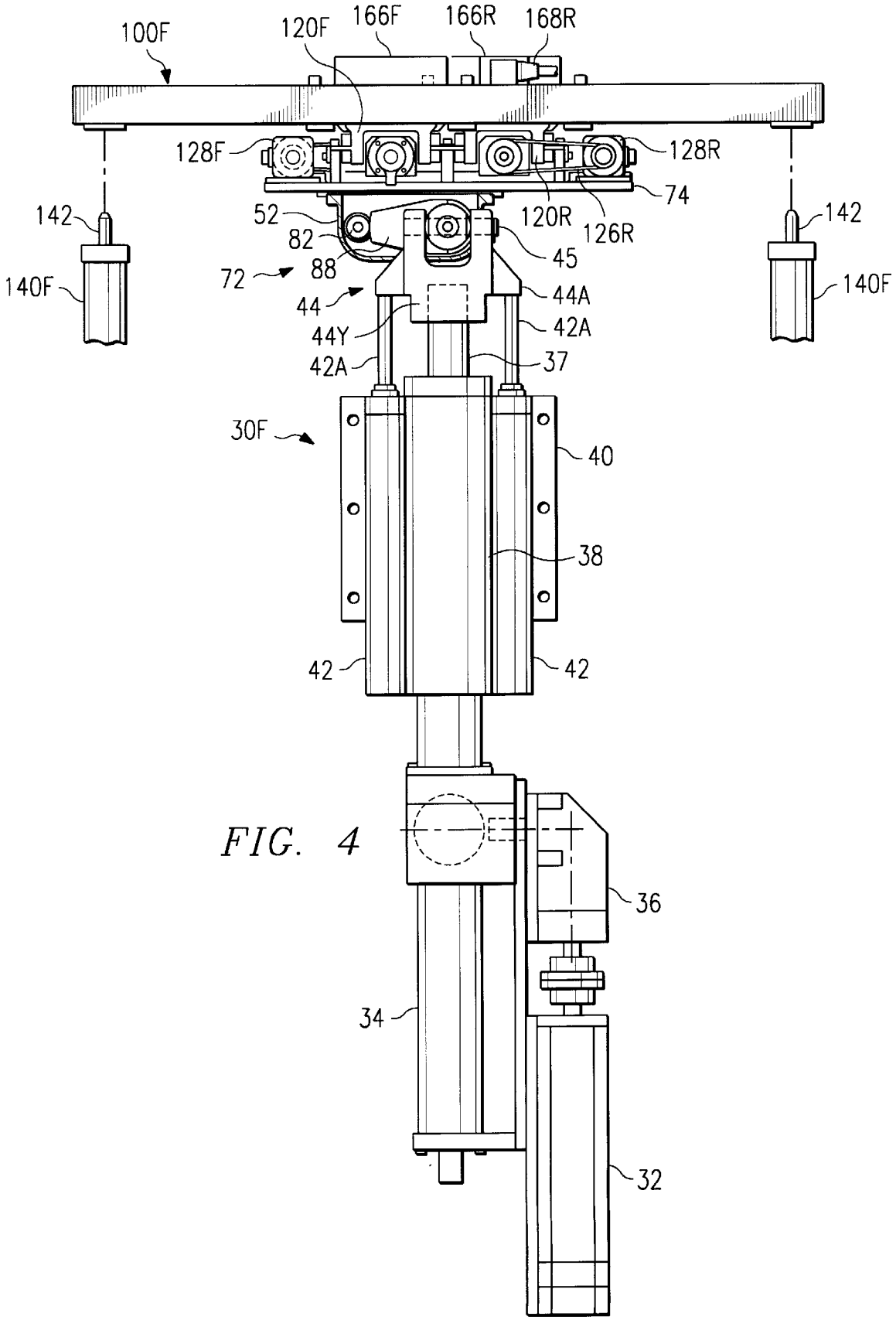
FIG. 4 is a front elevational view of the embodiment.

The front and rear vertical drive devices 30F and 30R, which are shown in FIGS. 2 to 4, are identical, so only the front drive 30F will be described. A servo-motor 32 drives a rack and pinion drive 34 through a gearbox 36. The rack (not shown) is coupled to a guide/force rod 37, which is guided vertically by a guide tube 38. A mounting plate 40 on the guide tube 38 enables the vertical drive 30 to be attached to a suitable support, such as the casing or brackets on the clamp module 14-I or 14-II (FIG. 1). Pneumatic load balancers 42 fastened on the lateral walls of the guide tube carry part of the weight of the pivot carrier support bar and the components mounted on it (described below). The guide/force rods 37 of the front and rear vertical drives extend vertically and lie in a vertical plane that contains the flow axis of the orientation station. The pivot carrier support bar 50 bridges the clamp module 20 or any other device or system that is mounted between the bolsters B of the die stations 12.

A front coupling 44 connects the guide/force rod 37 and the load balancers 42 of the front vertical drive 30F to the front end of the pivot carrier support bar 70. The front coupling includes a yoke 44Y having arms 44A that are engaged by the force rods 42F of the load balancers. A pivot pin 45 spans the gap between the arms of the yoke and passes through a hole in the support bar, suitable pivot and lateral thrust bearings being incorporated. The front coupling 44 allows the front end of the carrier bar 50 to tilt about a horizontal axis defined by the pivot pin 45 but prevents the carrier bar from translating along the flow axis or rotating about the flow axis, relative to the rod 37 (i.e, the pivot carriage support bar 50 does not rotate about its own axis or translate along its own axis). The pivotal movement of the support bar 50 about the pivot pin 45 allows for tilting of the pivot carriage about a horizontal axis perpendicular to the flow axis of the orientation station.

A rear coupling 48 connects the rear vertical drive 30R to the rear end of the pivot carrier support bar 50. A yoke 49 has pivot pins 49P that support a linear guide bearing, which enables the rear end of the pivot carrier support bar to both move axially and tilt about a horizontal axis as the carrier bar tilts. The carrier bar 50 has a reduced diameter section 50*a* at the rear end which is machined and hardened for endurance under the sliding motion within the supporting linear guide.

Figure 5:
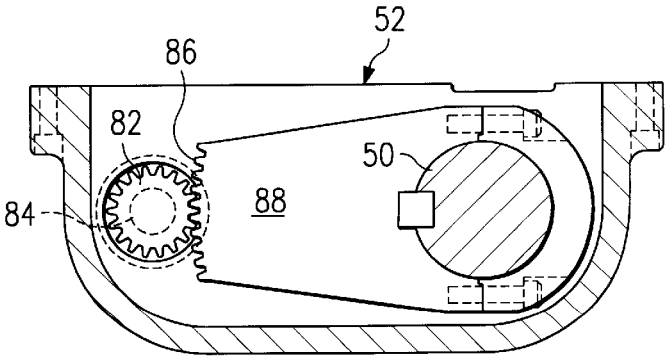
FIG. 5 is a partial front cross-sectional view of part of a roll drive of the embodiment, taken along the lines 5—5 of FIG. 2.

A front support bracket 52, which also serves as a housing for a roll linkage of the roll drive 72 (described below), and a rear support bracket 54 are pivotally mounted on the roll carriage support bar 50 and mount the roll carriage 70 for pivotal movement about the axis of the bearings (not shown) of the brackets 52 and 54, i.e., the roll axis of the station. The roll carriage includes a plate 74 and the roll drive 72 by which the plate is rolled from side to side about the roll axis. A servo-motor 76 (see FIG. 2) that is affixed by a mounting plate 78 to the underside of the roll carriage plate 74 drives through a coupling 80 a pinion 82 (see FIG. 5) that is affixed on the output shaft 84 of the coupling. The pinion 82 meshes with an arcuate gear sector 86 on the end of an arm 88 that is affixed to the roll carriage support bar 50. The output shaft 84 of the gear box is received by bearings in the opposite walls of the support bracket 52, thus strongly linking the output shaft 84 to the support bracket 52 and thus to the roll carriage plate 74. When the pinion 82 rotates, it "walks" along the gear sector 86, thereby rolling the roll carriage plate 74 clockwise or counterclockwise, depending on the direction of rotation of the pinion, about the roll axis.

The roll carriage plate 74 supports the front and rear template carrier bars 100F and 100R for movement along paths parallel to the roll axis and also supports the drives 120F and 120R by which the template carrier bars are moved to the desired positions. The front and rear carrier bars, the brackets on which they are mounted, the tracks on which the brackets run, and the drives by which they are moved are identical but are mounted on the carriage plate 74 in positions that are reversed end for end. Thus, as is best shown in FIG. 2, the rear drive 120R for the rear template carrier bar 100R is mounted adjacent the front end of the roll carriage plate 74, and the front drive 120R for the front template carrier bar 100R is mounted adjacent the front end of the roll carriage plate 74. Because the front and rear template carriage units are the same, the following description applies to both of them. Some of the reference numerals used in the description are applied in the drawing to both units, and thus the reference numerals in the drawings include the letter suffixes "F" for components of the front unit and "R" for components of the rear unit.

The template carrier bar 100 is affixed to a carrier bar support bracket 102, which is of a generally inverted U-shape. Sets of upper and lower rollers 104 and 106 (see FIG. 7) and side rollers (not shown) for lateral rolling support mounted on the support bracket run along an outboard rail 108 and an inboard rail 110 (the front and rear units share a common inboard rail 110). The support bracket 102 carries in a housing 122 the split ball nut driven element (not shown) of a ball nut and screw drive. The screw shaft 124 extends along the full length of the roll carrier plate 74 and is driven through a belt drive 126 by a servo motor 128.

The servo motors of the vertical, roll and template carrier bar drives 30F, 30R, 72, 120F and 120R are linked to a computer, which is programmed to control the movements of the roll carriage 70 and the template carrier bars to establish the desired orientation of the template carrier bars 100F and 100R to receive work pieces from the adjacent upstream die station of the transfer press in one orientation and move the template carrier bars 100F and 100R to another orientation for transfer of the work pieces from the orientation station to the adjacent downstream die station (see FIG. 1). In particular, the vertical drives 30F and 30R move the roll carriage 70 to a desired height and front to rear tilt angle (positive or negative). The roll drive 72 rolls the carriage to a desired side to side roll angle. The template bar carriage drives 120F and 120R move the template carrier bars 100F and 100R to desired positions on the roll carriage 70. Usually, the template carrier bars are moved in tandem, but for multiple parts, they can move independently.

Figure 6:
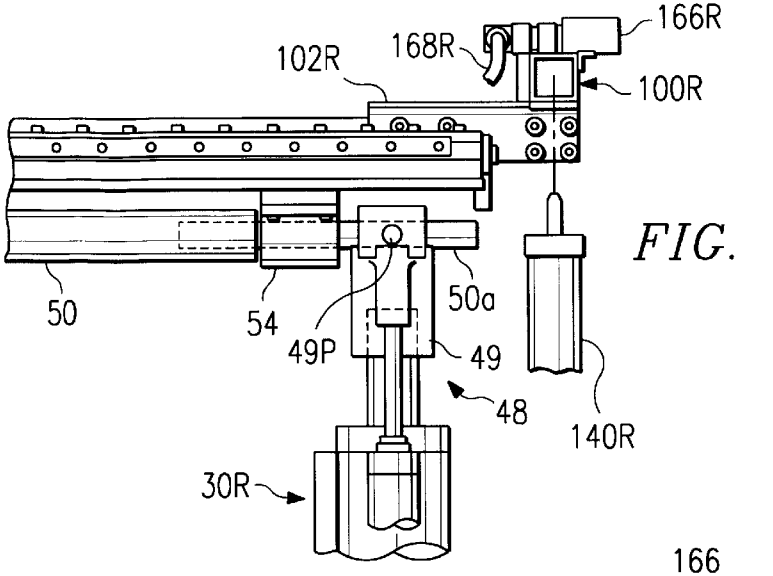
FIG. 6 is a partial right side elevational view of the embodiment, showing the rear template carrier bar extended rearwardly to a position for placing the rear template carrier bar on the rear template pedestal.

The orientation station of the present invention facilitates changing the templates during a tooling change to set up the transfer press to make another article by transferring the template carrier bars 100F and 100R from the roll carriage 70 to front and rear pairs of template bar pedestals 140F and 100R mounted, respectively, in spaced apart relation from the front and rear ends of the roll carrier plate 74 (see FIGS. 4 and 6). Each template bar pedestal has a pin 142 that is received in a receptacle (not shown) in the end of the template carrier bar 100. The roll carriage 70 is moved by the vertical drives 30 and roll drive 72 to zero tilt and roll angles and raised high enough to enable the template carrier bars 100 to clear the upper ends of the pins 142. The template carriages are then driven by the drives 120 appropriately to move portions of the carrier brackets 102 off the ends of the rails 108 and 110 (see FIG. 6) and position the template carrier bars 100 with their receptacles in vertical register with the pedestal pins 142.

Figure 7:
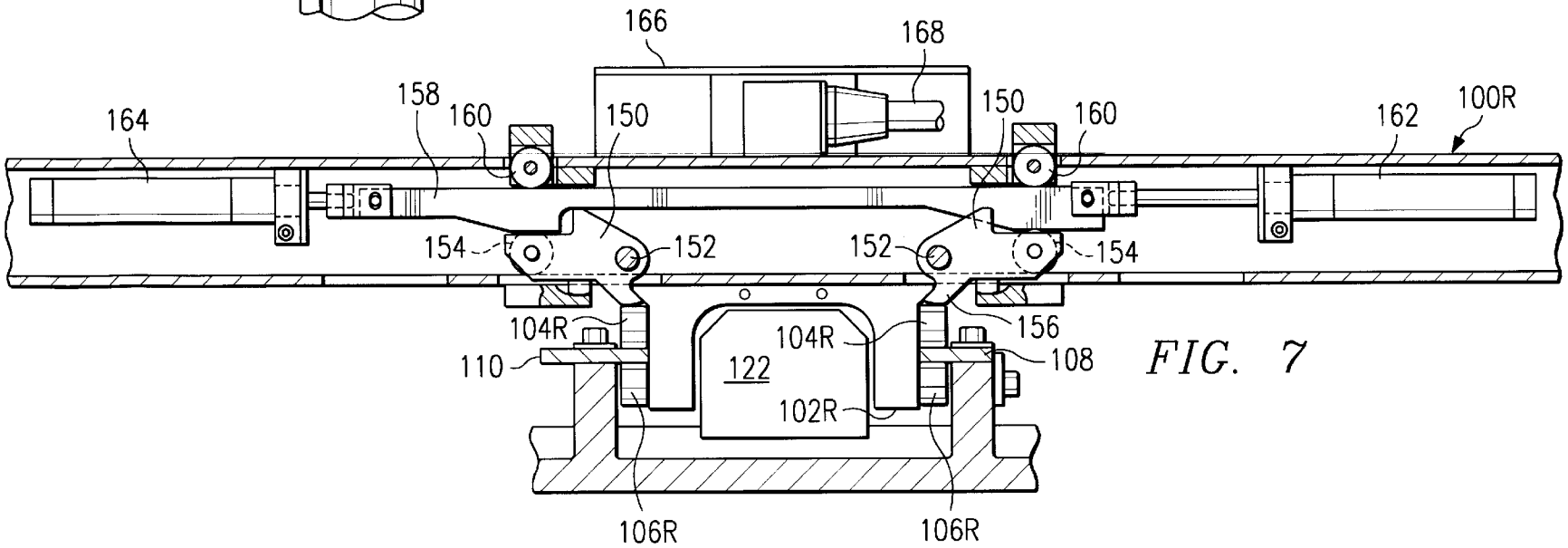
FIG. 7 is a partial front cross-sectional view of the rear template carriage.

As mentioned above, the front and rear template carrier bars 100F and 100R are identical, but reversed end for end. FIG. 7 shows the rear carrier bar and an automatic and remotely controlled mechanism by which the rear template carrier bar is released from the carrier bracket 102R and left on the pedestals 140R. The following generic description is fully applicable to the front barrier bar 100F.

Figure 8:
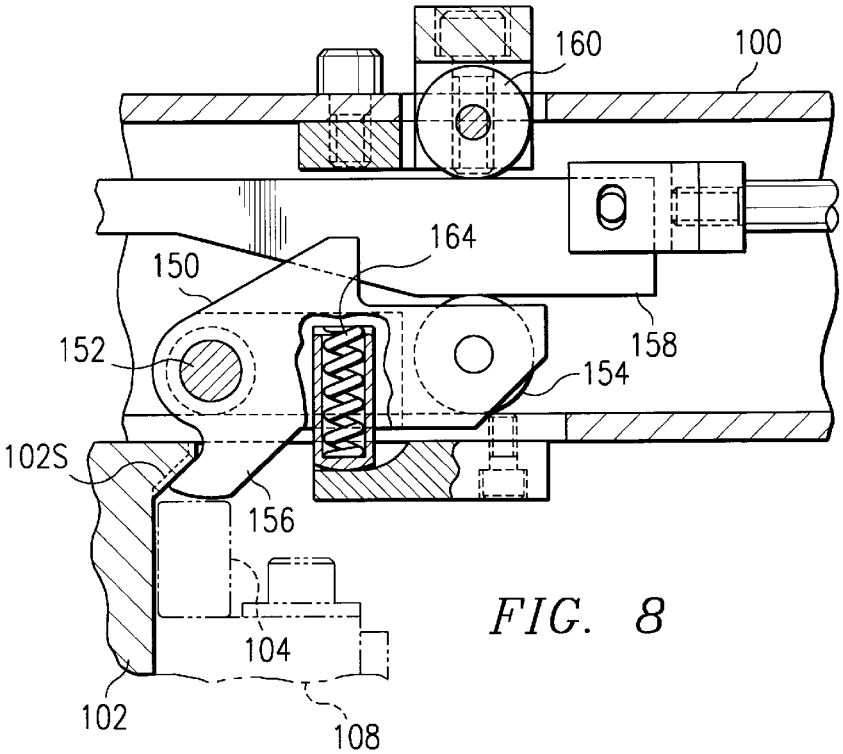
FIG. 8 is a fragmentary cross-sectional view that shows the right latch lever of the rear template carrier bar in the engaged position.
Figure 9:
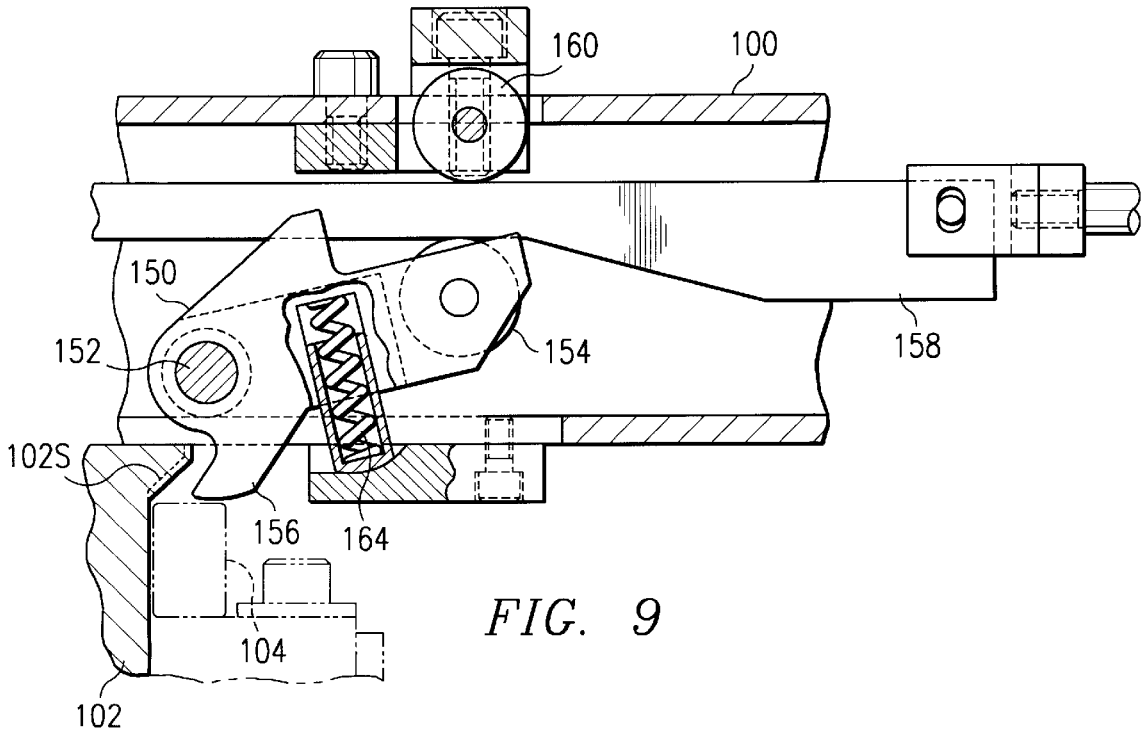
FIG. 9 is a fragmentary cross-sectional view that shows the right latch lever of the rear template carrier bar in the disengaged position.

The template carrier bar 100 is tubular and receives a pair of latch levers 150 between the side walls of the bar 100. Each latch lever 150 is pivotally mounted on a pivot pin 152, carries a cam follower roller 154, and has a latch hook portion 156 that protrudes through a slot in the bottom wall of the bar 100 and, when engaged with the carrier bracket 102 (FIGS. 7 and 8), engages a notch in the shoulder 102S of the carrier bracket 102. A bar cam 158 is supported within the template carrier bar 100 for reciprocating movement, the supports including back-up rollers 160 located generally opposite the cam follower rollers 154. The bar cam 158 is driven by opposed pneumatic piston/cylinders 162 and 164. The drawings do not show the supply hoses for the cylinders or any of the limit and proximity switches associated with the latch mechanism of the template carrier bar 100 but do show a wiring terminal box 166 and input/output cable 168. As is clear from FIGS. 7 to 9, the bar cam 158 has raised surfaces that work against the follower rollers 154 to hold the latch levers 150 in engagement with the carrier bracket 102 (FIG. 8) when the cam bar is moved to the left (FIG. 7) and depressed surfaces that release the latch levers (FIG. 9) when the cam bar is moved to the right. Release springs 164 pivot the latch levers to the released positions.

With the template carrier bars 100 positioned in vertical register with the template bar pedestals 140, as described above, the vertical drives 30F and 30R are operated to lower the template carrier bars onto the pedestals. The receptacles on the template carrier bars have tapered entrance portions, so that exact register of the bars 100 with the pins 142 is not required. Proximity switches (not shown) on the end of the bars detect the approach of the carrier bars to the pedestals and trigger the release of the latch levers. The vertical drives continue to lower the roll carriage 70 until the template carrier bars 100 are released to the pedestals and the carriage 70 is clear below the template carrier bars, whereupon the carrier brackets 102 can be driven back toward the axial center of the roll carriage plate 74.

After removal of the templates then in place on the template carrier bars and installation of templates for the next article to be worked on the press, the above procedure for releasing the template carrier bars from the orientation station to the pedestals is reversed to pick up the template carrier bars from the pedestals.

We claim:

1. An orientation station for a multi-station metal-forming machine comprising a front vertical drive adapted to be attached to a support proximate to an upstream work station of the machine;

a rear vertical drive adapted to be attached to a support proximate to a downstream workstation of the machine;

the front and rear vertical drives being spaced apart from each other along a flow axis of the orientation station that is adapted to coincide with a flow axis of the machine along which articles being formed move between from the upstream work station to the downstream work station;

a pivot carriage support bar coupled at a front end to the front vertical drive and coupled at a rear end to the rear vertical drive, the vertical drives being operable to adjust the position of the pivot carriage support bar to a predetermined height and to orient the pivot carriage support bar at a predetermined tilt angle about a horizontal tilt axis of the orientation station perpendicular to the flow axis;

a pivot carriage mounted on the pivot carriage support bar for rotation about a roll axis defined by the pivot carriage support bar;

a roll drive coupled between the pivot carriage support bar and the pivot carriage and being operable to rotate the pivot carriage about the roll axis to a selected roll position;

front and rear template carrier bars positioned transversely with respect to the roll axis and mounted on the pivot carriage in spaced-apart relation axially with respect to the roll-axis for movement along paths parallel to the roll-axis; and means for moving the template carrier bars along the paths to predetermined positions.

2. An orientation station according to claim 1 wherein each of the template carrier bars is supported on the pivot carriage independently of the other.

3. An orientation station according to claim 2 wherein each of the template carrier bars is mounted on a carrier bar support bracket, and each carrier bar support bracket is received for movement along a carriage track on the pivot carriage.

4. An orientation station according to claim 3 wherein the front template carrier bar is mounted on a front carrier bar support bracket, the front carrier bar support bracket is received for movement along a front carriage track, the rear template carrier bar is mounted on a rear carrier bar support bracket, and the rear carrier bar support bracket is received for movement along a rear carriage track.

5. An orientation station according to claim 4 wherein the means for moving the template carriages includes a front template carriage drive coupled between the pivot carriage and the front carriage track and a rear template carriage drive coupled between the pivot carriage and the rear carriage track.

6. An orientation station according to claim 5 wherein the front carriage track and rear carriage track are mounted on the pivot carriage proximate to each other and symmetrically with respect to a vertical plane that includes the roll axis.

7. An orientation station according to claim 6 wherein each of the front and rear template carriage drives is a ball screw and ball nut drive driven by a servo-motor and drive belt.

8. An orientation station according to claim 8 wherein the servo-motor and drive belt of the front template carriage are mounted on a rear end of the pivot carriage and the servo-motor and drive belt of the rear template carriage are mounted on a front end of the pivot carriage.

9. An orientation station according to claim 4 and further comprising a front template pedestal spaced apart from the front end of the pivot carriage and arranged to receive and support the front template carrier bar during a tool change and a rear template pedestal spaced apart from the rear end of the pivot carriage and adapted to receive and support the rear template carrier bar during a tool change.

10. An orientation station according to claim 9 wherein the front carrier bar is movable along the front track to a position in vertical register with the front template pedestal and the rear carrier bar is movable along the rear track to a position in vertical register with the rear template pedestal.

11. An orientation station according to claim 10 wherein each template carrier bar is attached to the carrier bar support bracket by a clamping mechanism that is selectively releasable to detach the template carrier bar from the support bracket.

12. An orientation station according to claim 11 wherein each clamping mechanism is automated and remotely controllable.

13. An orientation station according to claim 12 wherein each clamping mechanism is received by the template carrier bar and includes latch levers pivotally mounted on the carrier bar and engageable with the support bracket and means carried by the support bar for selectively moving the levers into and out of engagement with the support bracket.

14. An orientation station according to claim 13 wherein the means for selectively moving the levers into and out of engagement with the support bracket includes a cam and cam followers on the latch levers.

15. An orientation station according to claim 14 wherein the cam is a bar cam that is driven by air cylinders.

16. An orientation station according to claim 15 wherein the template carriage bar is tubular and the bar cam and air cylinders are received within the template carriage bar.

17. An orientation station according to claim 1 wherein the front vertical drive has a movable drive rod that is coupled to the front end of the pivot carriage support bar by a front coupling, the rear vertical drive has a movable drive rod that is coupled to the rear end of the pivot carriage support bar by a rear coupling, and the couplings are arranged to prevent one end of the pivot carriage support bar from moving axially relative to the drive rod to which said one end is coupled and to prevent the pivot carriage support bar from rotating about the roll axis.

18. An orientation station according to claim 1 wherein the roll drive includes a roll servo-motor mounted on the pivot carriage and a roll drive linkage coupled between the roll servo-motor and the pivot carriage support bar.

19. An orientation station according to claim 18 wherein the roll drive linkage includes an arcuate gear sector affixed to the pivot carriage support bar and concentric with the roll axis and a drive pinion coupled to the roll servo-motor and meshing with the gear sector.

20. An orientation station for a multi-station metal-forming machine comprising a pivot carriage that is automatically adjustable to a predetermined height relative to the machine, to a predetermined tilt angle about a horizontal tilt axis of the orientation station perpendicular to a flow axis along which articles to be formed by the metal-forming machine move between the forming stations, and to a predetermined roll angle about a roll axis of the orientation station lying in a vertical plane that includes the flow axis and forming an angle with the flow axis equal to the tilt angle;

a front template carriage mounted on a first track on the pivot carriage for movement along a path parallel to the roll-axis and a front template carriage drive coupled between the pivot carrier and the front template carriage and being operable to move the front template carriage to predetermined positions along the first track; and a rear template carriage mounted on a second track on the pivot carriage for movement along a path parallel to the roll-axis and a rear template carriage drive coupled between the pivot carriage and the rear template carriage and being operable to move the rear template carriage to predetermined positions along the second track.

21. An orientation station according to claim 20 wherein the front template carriage includes a front template carrier bar oriented transversely of the flow axis and a front carrier bar support bracket and the rear template carriage includes a rear template carrier bar oriented transversely of the flow axis and a rear carrier bar support bracket.

22. An orientation station according to claim 21 wherein the front carriage track and rear carriage track are mounted on the pivot carriage proximate to each other and symmetrically with respect to a vertical plane that includes the roll-axis.

23. An orientation station according to claim 22 wherein each of the front and rear template carriage drives is ball screw and ball nut drive driven by a servo-motor and drive belt.

24. An orientation station according to claim 23 wherein the servo-motor and drive belt of the front template carriage is mounted on a rear end of the pivot carriage and the servo-motor and drive belt of the rear template carriage is mounted on a front end of the pivot carriage.

25. An orientation station according to claim 23 and further comprising a front template pedestal spaced apart from the front end of the pivot carriage and arranged to receive and support the front template carrier bar during a tool change and a rear template pedestal spaced apart from the rear end of the pivot carriage and adapted to receive and support the rear template carrier bar during a tool change.

26. An orientation station according to claim 25 wherein the front template carrier bar is movable to a position in vertical register with the front template pedestal, the rear template carrier bar is movable to a position in register with the rear carrier pedestal, and each template carrier bar is attached to the carrier bar support bracket by a clamping mechanism that is selectively releasable to detach the template carrier bar from the support bracket to enable the template carrier bar to be placed on the carrier pedestal.

27. An orientation station according to claim 26 wherein each clamping mechanism is automated and remotely controllable.

28. An orientation station according to claim 27 wherein each clamping mechanism is received by the template carrier bar and includes latch levers pivotally mounted on the carrier bar and engageable with the support bracket and means carried by the support bar for selectively moving the levers into and out of engagement with the support bracket.

29. An orientation station according to claim 28 wherein the means for selectively moving the levers into and out of engagement with the support bracket includes a cam and cam followers on the latch levers.

30. An orientation station according to claim 29 wherein the cam is a bar cam that is driven by air cylinders.

31. An orientation station according to claim 30 wherein each template carrier bar is tubular and the bar cam and air cylinders are received within the template carrier bar.

* * * * *